US005221001A

United States Patent [19]

Eisman

[11] Patent Number: 5,221,001

[45] Date of Patent: Jun. 22, 1993

[54] MODULAR CARRIER WITH HANDLE INTERLOCK

[75] Inventor: Larry Eisman, Elkins Park, Pa.

[73] Assignee: Dopaco, Inc., Downingtown, Pa.

[21] Appl. No.: 939,145

[22] Filed: Sep. 2, 1992

[51] Int. Cl.[5] ..... B65D 75/00

[52] U.S. Cl. ..... 206/144; 206/180; 206/190

[58] Field of Search ..... 206/144, 170–177, 206/180, 190, 191, 427; 229/120.01, 120.14, 120.15, 120.18

[56] References Cited

U.S. PATENT DOCUMENTS 2,665,838 1/1954 Forrer ..... 206/144

3,404,805 10/1988 Stockman et al. ..... 206/144

5,069,335 12/1991 Beales .

*Primary Examiner*—Jimmy G. Foster

*Attorney, Agent, or Firm*—Dennison, Meserole, Pollack & Scheiner

[57] ABSTRACT

A two pack carrier adapted for coupling to a duplicate carrier and including a lower basket and an upper handle integral therewith. The handle includes a latch lug thereon in the plane of one side of the carrier immediately adjacent a transverse wall of the handle. The transverse wall of the handle, adjacent the lug, includes a lug-receiving aperture and a lug-locking flap, the aperture receiving the lug of an adjacent carrier which is in turn locked within the aperture by the locking flap.

14 Claims, 2 Drawing Sheets

FIG. 1
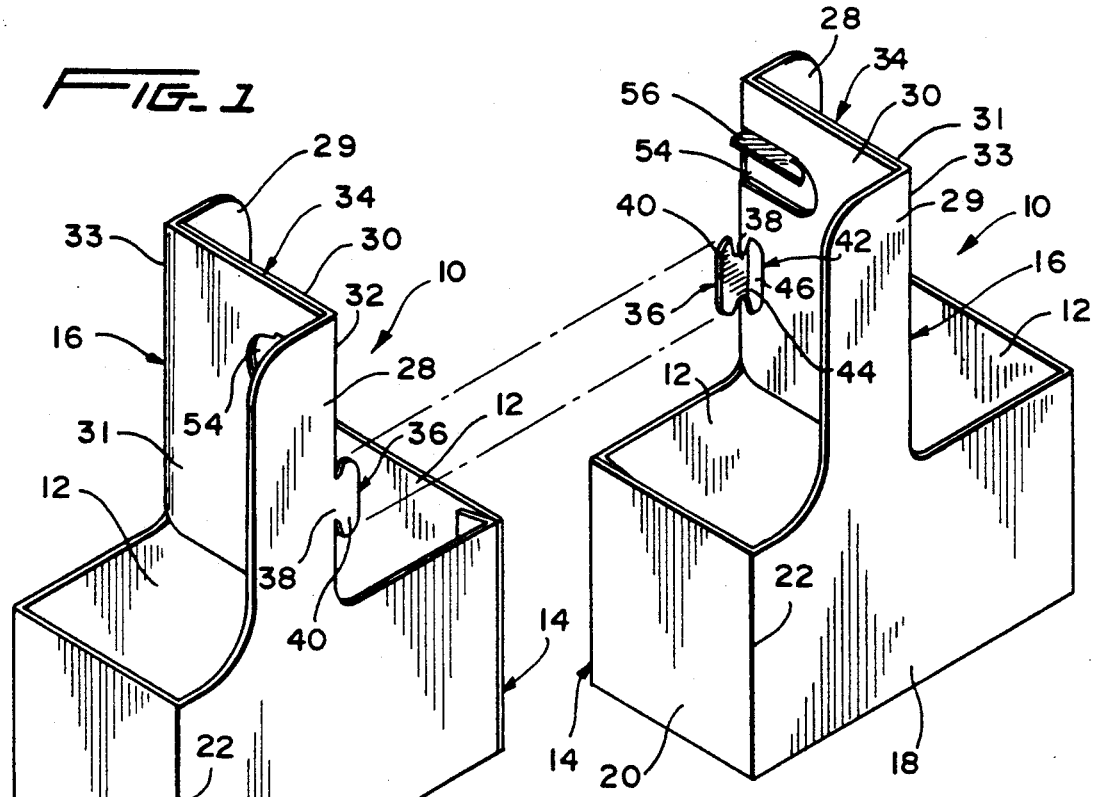
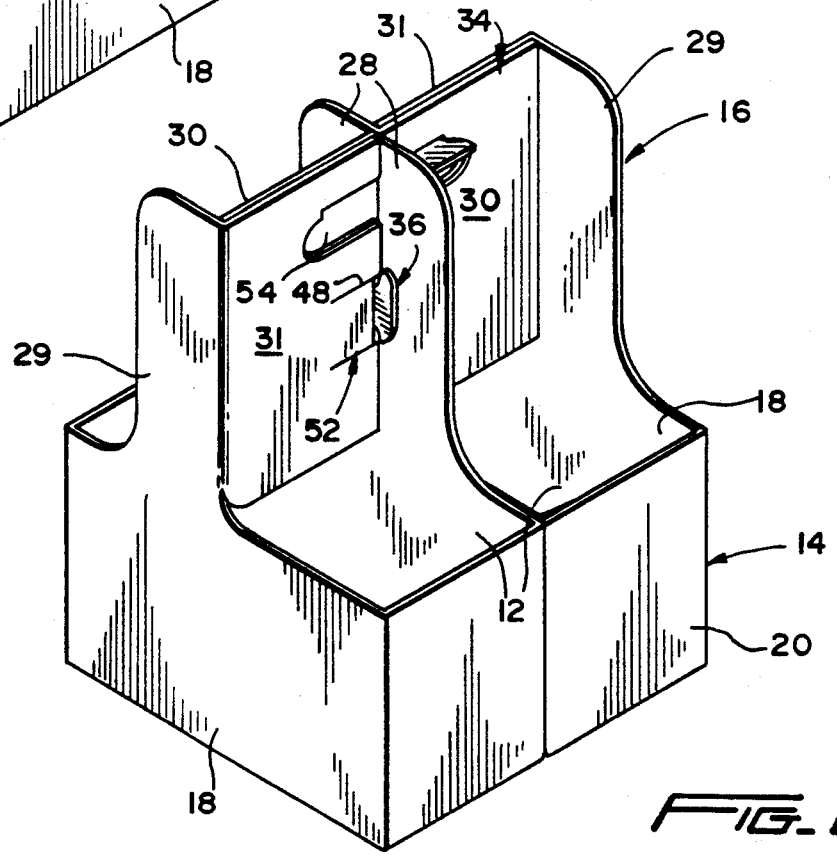
FIG. 2

MODULAR CARRIER WITH HANDLE INTERLOCK

BACKGROUND OF THE INVENTION

The invention broadly relates to cartons formed from unitary blanks of paperboard, and is more particularly concerned with cartons in the nature of carriers including a box or basket portion which receives the articles, and an upwardly projecting handle for a carrying of the carton received articles.

An example of a dual compartment or two pack carrier of the general type herein involved will be noted in U.S. Pat. No. 5,069,335, issued to Beales on Dec. 3, 1991.

Cartons of this type are particularly adapted for carrying two bottles or cans received within separate compartments defined by a transverse positioning of the handle across the basket. The Beales carrier is also modular, that is capable of being joined to a duplicate carrier or carton to define a four compartment or four pack carrier supportable by a combined handle readily held in one hand.

In the Beales carrier, dual interlocks are provided between the two duplicate modules at opposite ends of the basket. A separate joinder is provided between the handles adjacent the upper ends thereof. In requiring interlocks at three separate locations, manipulation to join the Beales cartons is relatively complex. Specifically, the baskets are interlocked by a lateral movement thereof toward each other, while the handles require a transverse movement thereof relative to each other at right angles to the basket-interlocking movement.

It will also be noted that the latching tongue of Beales forms a projection laterally outward of the plane of one side of the carton which could interfere with the storing of the carton within a larger box or on a refrigerator shelf. In addition, formation of the Beales tongue beyond one edge of the blank will result in substantial waste of material as adjacent blanks are cut from a continuous sheet.

SUMMARY OF THE INVENTION

The modular two compartment or pack carrier of the invention constitutes a distinctive advance in the art as exemplified by the Beales patent. Specifically, the carrier of the invention is a modular unit adapted to interlock with a duplicate unit at a single point on the handles with the resultant four compartment assembly defining a stable assembly. In conjunction therewith, it is contemplated that the means for latching or interlocking the modular carriers require only a single directional movement of the carriers relative to each other with the resultant joinder being secure against accidental disengagement and being disassemblable only by a positive or intentional manual manipulation.

Upon a joinder of the two carriers into a four compartment assembly in accord with the invention, the handles are positively interlocked against movement relative to each other in any direction. As such, the combined handles form a single unit easily grasped by a single hand. No separate interlock of the basket portions themselves is utilized or required.

Structurally, the two compartment carrier includes a box or basket portion with elongate sides in laterally spaced planes. A handle centrally overlies the basket and includes opposed side panels coplanar with the opposed sides of the basket, and a transverse handle wall between the side panels. One of these side panels includes a coplanar projecting latch lug centrally along the height thereof and extending beyond the transverse handle wall. The transverse wall, immediately inward of the lug, is provided with a similar configured latch aperture. The latch aperture is covered by a pivotal locking flap. Upon positioning of two duplicate carriers, rotated 180° relatively to each other, each latch lug is engaged through the latch aperture of the other carrier with both engaged latch lugs automatically locked against withdrawal from the corresponding aperture both by the shape of the lugs and by the associated locking flaps engaging thereagainst.

An elongate finger opening is provided through the transverse handle wall adjacent the side panel having the projecting lug, the finger openings of two joined carriers defining a single handhold above the point of interlock.

By providing for the single latching position vertically spaced above the baskets of the two carriers and between the inner side panels, the handles and handholds are fixedly retained in position for easy grasping. Further, any introduced loads within the baskets, adapted for example to accommodate four bottles, would, upon a lifting of the joined carriers, tend to inwardly pivot or bias the baskets toward each other about the joinder, thus retaining the baskets intimately engaged without the necessity of providing a specific interlock between the baskets themselves.

Formation of the latch lug within the plane of the side of the carrier provides projection free outer surfaces, avoiding the disadvantages of interfering lateral projections in the erected carton, and excess material and waste in the Additional objects, features and advantages of the invention will become apparent from the details of construction and manner of use as more fully hereinafter presented.

BRIEF DESCRIPTION OF THE DRAWINGS

FIG. 1 is a perspective view illustrating two of the modular two pack carriers aligned for assembly;

FIG. 2 is a perspective view of the two carriers assembled;

DESCRIPTION OF THE PREFERRED EMBODIMENTS

Figure 3:
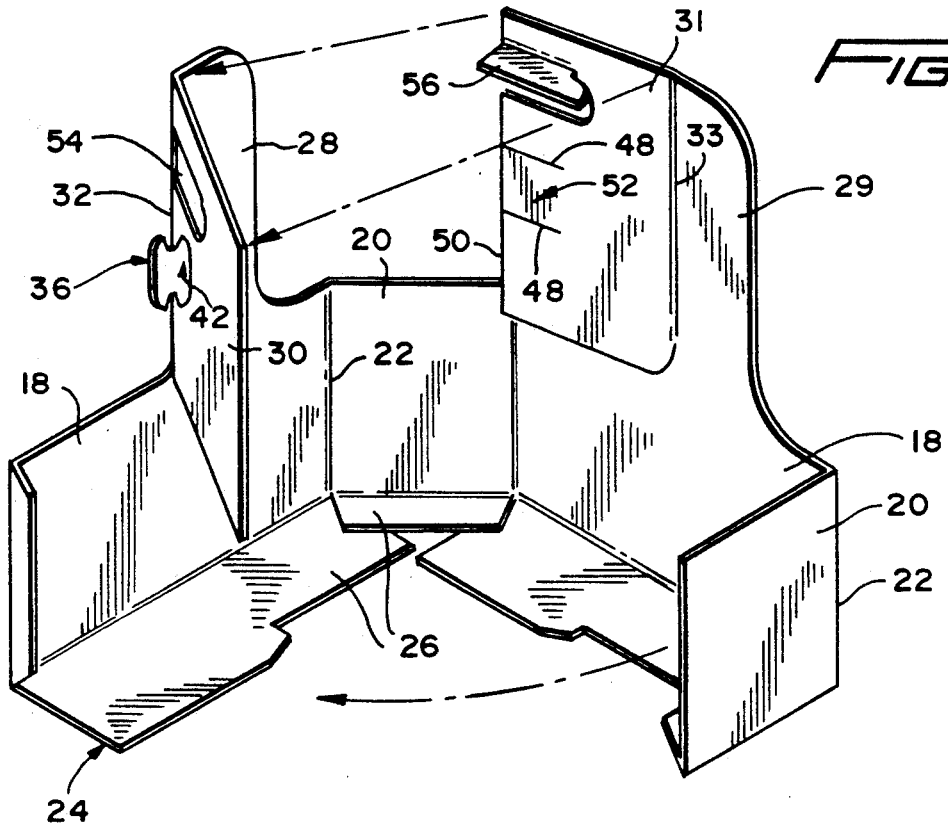
FIG. 3 is a perspective view of a partially assembled carrier illustrating in particular the handle structure.

Referring now more specifically to the drawings, the paperboard carton or carrier 10 is a two pack unit formed with two separate aligned compartments 12 from a single blank of folded paperboard appropriately scored, cut and folded along defined lines as suggested in FIG. 3.

The carrier includes a box or basket 14 and a handle 16 integral therewith. The basket 14 is of an elongate rectangular configuration with opposed side walls 18 and opposed end walls 20 extending between the side walls and joined thereto at the corners 22 by appropriate fold lines. The bottom 24 of the basket is formed by panels 26 in a known manner to automatically define the bottom as the carton is expanded from a flattened configuration to an open in use configuration. The top of the basket 14 is open.

The handles 16 includes opposed side panels 28, 29 one integral with and extending vertically upward from the upper edge of each side wall 18 coplanar therewith. The side panels 28, 29 are longitudinally offset relative to each other with each including an integral transverse panel 30, 31 folded at right angles to the inner edge 32, 33 of the corresponding side panel 28, 29. The transverse panels 30, 31 overlie and are bonded to each other centrally across the open top of the basket 14 to define a transverse handle wall 34 dividing the box into the two compartments 12. The side panels 28, 29 extend partially along the opposed longitudinal sides of the two compartments 12 in opposite directions from the central handle wall 34.

The side panel 28, vertically spaced above the upper edge of the corresponding basket side wall 18, and slightly below mid height on the side panel 28, has a coplanar latch lug 36 extending therefrom. The lug 36 is in the plane of the box side wall 18 therebelow and includes a narrow neck 38 and a vertically elongate head 40 including upper and lower locking lobes. The latch lug 36 is defined from the adjacent transversely extending folded panel 30 by appropriate cutlines, whereby upon a folding of the transverse panel 30, the lug 36 remains in projecting coplanar relation with the side panel 28. As will be recognized, a corresponding latch aperture 42 is formed in the transverse panel 30 immediately adjacent and laterally aligned with the latch lug 36 and similarly including a narrow neck 44 and a vertically elongate head 46.

The second transverse handle panel 31, which is of substantially equal transverse width with the panel 30, overlies the latch aperture 42 for substantially the full transverse extent thereof other than for a narrow portion of the aperture neck 44, approximately equal to or slightly larger than the thickness of the paperboard, adjacent the opposed side panel 28.

The transverse panel 31, immediately above and below the latch aperture 42 in the panel 30 has a pair of transverse cut lines 48 extending inward from the free edge 50 of the panel a distance equal to approximately two and one-half times the transverse width of the latch aperture 42, thus defining a flexible locking flap 52 with a free edge 53. Flap 52 is not bonded to the apertured panel 30 whereby resiliently flexible movement relative thereto, due to an inherent degree of resilient flexibility within the paperboard material itself, is possible for reasons to be explained subsequently.

In order to lift the carrier 10, the transverse handle wall 34 has a transversely elongate finger opening 54 therein, extending from the fold edge 32 of the side panel 28 for approximately one-half the width of the wall 34.

The opening 54 is defined through both transverse panels 30 and 31 with panel 31 including a depending folding flap or tab 56 which can fold about the elongate upper edge of the opening 54 and provide for a slight cushioning effect for the fingers.

The carrier 10, as described, is intended for use either as a two pack carrier or for use in interlocked tandem with a duplicate carrier to form a four pack carrier assembly. The joining of duplicate carriers 10 is effected simply and rapidly, utilizing the single latch assembly, by positioning the two carriers 10 slightly longitudinally offset from each other and with the latch lugs aligned with each other and the latch apertures 42 of the opposed carriers.

Figure 4:
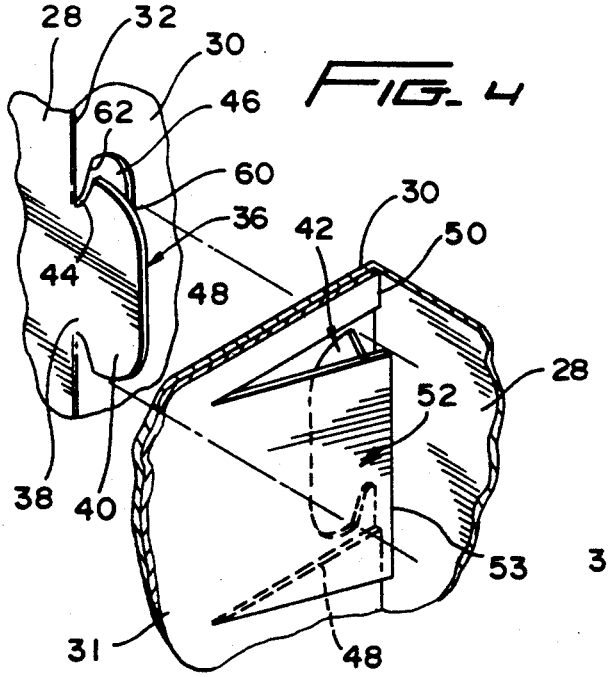
FIG. 4 is an exploded detail illustration of the latching components.
Figure 5:
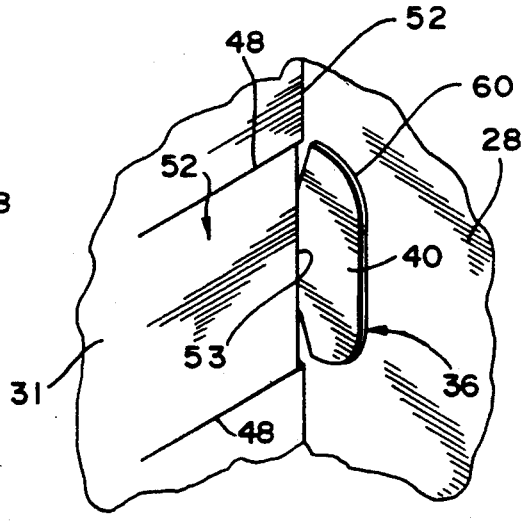
FIG. 5 is a detail illustration of engaged latching components.

The carriers 10 are then longitudinally slid toward each other to engage each latch lug 36 inward of the latch lug of the opposed carrier, effecting an overlap between the lugs which restricts lateral separation of the carriers as the latching movement continues. This inward engagement of the respective latch lugs 36 may require a slight deflection of at least one of the lugs. Alternately, and noting the orientation of the two carriers 10 in FIG. 1, the carriers can be pivotally swung toward each other, with or without a slight lateral tipping, to automatically position the lugs each immediately inward of the other. With each of the latch lugs so engaged, continuous longitudinal shifting of the carriers 10 relative to each other will result in an extension of each lug 36 through the latch aperture 42 of the opposed carrier. In light of the configuration of the latch lugs 36 and latch apertures 42, including the narrow necks and enlarged head portions, it will be recognized that the head portions 40 of the lugs 36 will only conveniently pass through the head portions 46 of the apertures 42. As such, there will be a slight flexing of the lugs to allow this passage. This slight flexing is provided for by the inherent flexible resiliency of the paperboard of the carriers. Further, and as possibly best seen in the detail illustrations of FIGS. 4 and 5, the outer edges 60 of the lobes of the lug head 40 are slightly rounded or beveled, as are both the inner and outer edge portions 62 of the lobe areas of the aperture head portions 46.

Once the latch lugs 36 engage through the opposed latch apertures 42, the inherent flexible resiliency of the lugs will position each lug against the inner face of the handle side panel 28 of the adjoining carrier 10, thus in effect nesting the neck 38 of each latch lug within the corresponding neck 44 of the cooperating latch aperture 42. So engaged, the lugs are precluded from withdrawal.

In order to further stabilize and insure the integrity of the joinder, each latch lug 36 is retained in its final latching position by a locking flap 52 associated with the corresponding latch-receiving aperture 42. Each flap 52, defined by the upper and lower cut lines 48, flexes resiliently outward from the corresponding handle wall 34 as the latch lugs 36 engage through the apertures 42. Once the lugs have been projected completely through the apertures, and lie against the respective inner faces of the handle side panels 28, the locking flaps 52, through the inherent flexibility thereof, move back to their original positions coplanar with the corresponding sides of the transverse handle wall 34 with the free edges 53 of the flaps 52 engaging against the latch lugs 36 and retaining the latch lugs with the necks of the lugs and apertures positively engaged. The free edge 53 of each locking flap may be slightly spaced from the inner face of the corresponding handle side panel 28 to allow for accommodation of the opposed latch lug therebetween and parallel thereto.

When so engaged, it will be appreciated that accidental or unintentional disengagement of the two carriers is not possible. Rather, if the carriers are to be disengaged, a positive manual manipulation, involving an outward pivoting and release of the locking flaps and a subsequent manipulation of the lugs, will be required. With the two carriers interlocked, the two handles 16 align transversely across the assembly and the two elongate finger openings 54 are positioned for easy grasping within one hand, for example with two fingers of the hand engaging through each opening 54. The positive interlock between the carriers within the handles themselves, immediately below the finger openings, provides for a positive retention of the handles against each other in a manner which substantially defines a single handle for ready access thereto and without requiring additional means to insure a proper alignment of the two handles 16. Similarly, the single latch joinder assembly, positioned in spaced relation above the lower basket 14, will be equally effective in retaining the two baskets in intimate engagement with each other, providing in effect a single carrier assembly. It will be appreciated that any load within the two baskets, for example four bottles, will, by the natural direction of the load force, retain the baskets in lateral engagement with each other while the single latch interlock assembly similarly retains the inner handle side panels 28 in engagement.

While the carrier has been described as being formed Of paperboard, it will be appreciated that other similar flexibly resilient yet substantially rigid sheet material can be used, assuming such material is susceptible of allowing a folding of the carrier from a blank appropriately die cut and scored.

The foregoing is illustrate of the features of the invention and not as limitations on the scope of the invention as claimed hereinafter.

I claim:

1. A carrier usable both as a single unit and interlockable with a duplicate companion carrier, said carrier being formed of foldable sheet material and comprising an upwardly opening basket including laterally spaced first and second generally planar side walls, a handle over said basket, said handle including opposed first and second side panels comprising upwardly directed extensions of said first and second side walls respectively, a handle wall fixed to and extending transversely between said side panels and across said basket, a latch lug on said first side panel and a latch aperture defined through said handle wall immediately adjacent said latch lug, said latch lug and said latch aperture being interlockable with a similar aperture and lug respectively on the companion carrier for a joining of said carrier and the companion carrier, said latch lug extending from said first side panel generally within the plane of said first side wall and in spaced relation above said basket, and locking means on said handle wall for engaging an aperture-received latch lug of the companion carrier for restricting withdrawal of the engaged latch lug from said aperture, said locking means comprising a locking flap formed from said sheet material and at least partially overlying said latch aperture, said flap being resiliently flexible to resiliently retract from said aperture and allow introduction of a latch lug through said aperture.

2. A carrier usable both as a single unit and interlockable with a duplicate companion carrier, said carrier being formed of foldable sheet material and including an upwardly opening basket with opposed first and second side walls in laterally spaced planes and opposed end walls extending between and joining said side walls, said side and end walls prepresenting continuous projecting-free outer surfaces, a handle over said basket, said handle including opposed first and second side panels comprising coplanar vertical extensions of said first and second side walls respectively, said side panels having vertical inner edges transversely aligned across said basket, and a handle wall fixed to and extending transversely between said inner edges and across said basket, a latch lug on said first side panel and a latch aperture defined through said handle wall immediately adjacent said latch lug, said latch lug and said latch aperture being interlockable with a similar aperture and lug respectively on the companion carrier for a joining of said carrier and the companion carrier, said latch lug extending from said first side panel inner edge within the plane of said first side panel and in vertically spaced relation above said basket, and locking means on said handle wall for engaging an aperture-received latch lug of the companion carrier for restricting withdrawal of the engaged latch lug from said aperture, said locking means comprising a locking flap formed from said sheet material and at least partially overlying said latch aperture, said flap being resiliently flexible to resiliently retract from said aperture and allow introduction of a latch lug through said aperture.

3. The carrier of claim 2 wherein said latch lug includes an enlarged head portion outwardly spaced from said first side panel inner edge, and a narrower neck portion joining said head portion to said first panel inner edge, said latch aperture including an enlarged head portion and a narrower neck portion, said aperture head portion being transversely spaced from said first side panel inner edge and of the same general size as said lug head portion to allow passage of the lug head portion of the duplicate companion carrier there through, said aperture neck portion extending from said aperture head portion toward said first panel inner edge to accommodate the lug neck portion and preclude passage of the lug head portion of the companion carrier when joining said carrier and the companion carrier, said latch lug including a degree of flexible resiliency whereby said lug can flex out of the plane of said first side panel for passage through the head portion of the latch aperture of the companion carrier and resiliently return toward the plane of said first side panel to align with the neck portion of the latch aperture of the companion carrier.

4. The carrier of claim 3 wherein said locking flap is integral with said handle wall spaced from said first side panel and includes a free edge adjacent said first side panel for engagement against an aperture-received latch lug.

5. The carrier of claim 4 including a finger grip opening defined through said handle wall vertically spaced above said latch lug and said latch aperture whereby a pair of joined carriers can be manually grasped above the carrier joining lugs and apertures.

6. The carrier of claim 5 wherein said latch lug and said latch aperture comprise the sole means for joining said carrier and the companion carrier.

7. A carrier usable both as a single unit and interlockable with a duplicate companion carrier, said carrier being formed of foldable sheet material land including an upwardly opening basket with opposed first and second side walls in laterally spaced planes and opposed end walls extending between and joining said side walls, said side and end walls presenting continuous projecting-free outer surfaces, a handle over said basket, said handle including opposed first and second side panels comprising coplanar vertical extensions of said first and second side walls respectively, said side panels having vertical inner edges transversely aligned across said basket, and a handle wall fixed to and extending transversely between said inner edges and across said basket, a latch lug on said first side panel and a latch aperture defined through said handle wall immediately adjacent said latch lug, said latch lug and said latch aperture being interlockable with a similar aperture and lug respectively on the companion carrier for a joining of said carrier and the companion carrier, said latch lug extending from said first side panel inner edge within the plane of said first side panel and in vertically spaced relation above said basket, said latch lug including an enlarged head portion outwardly spaced from said first side panel inner edge, and a narrower neck portion joining said head portion to said first panel inner edge, said latch aperture including an enlarged head portion and a narrower neck portion, said aperture head portion being transversely spaced from said first side panel inner edge and of the same general size as said lug head portion to allow passage of the lug head portion of the duplicate companion carrier there through, said aperture neck portion extending from said aperture head portion toward said first panel inner edge to accommodate the lug neck portion and preclude passage of the lug head portion of the companion carrier when joining said carrier and the companion carrier, said latch lug including a degree of flexible resiliency whereby said lug can flex out of the plane of said first side panel for passage through the head portion of the latch aperture of the companion carrier and resiliently return toward the plane of said first side panel to align with the neck portion of the latch aperture of the companion carrier.

8. The carrier of claim 7 wherein said latch lug and said latch aperture comprise the sole means for joining said carrier and the companion carrier.

9. The carrier of claim 8 including a finger grip opening defined through said handle wall vertically spaced above said latch lug and said latch aperture whereby a pair of joined carriers can be manually grasped above the carrier joining lugs and apertures.

10. A modular carrier formed of a unitary blank of paperboard and having a basket with opposed side walls and opposed end walls, a handle over said basket and including opposed handle side panels comprising vertical extensions of said joining said handle side panels, and single latch means on said handle in vertically spaced relation above said basket for joinder of said carrier with a duplicate modular carrier solely at said handle, said latch means comprising a latch lug and a latch aperture of complementary configurations, each said lug and said aperture including an enlarged head portion and a narrower neck portion, whereby two of said modular carriers are latch joined by engagement of the lug head portion of each carrier through the aperture head portion of the other carrier, and precluded from disengagement upon alignment of the lug head portion of each carrier with the narrower aperture neck portion of the other carrier.

11. The carrier of claim 10 including locking means on said handle adjacent said latch aperture and selectively movable to engage an aperture-received latch lug to prevent withdrawal thereof.

12. The carrier of claim 11 wherein said latch lug extends from one handle side panel, said latch aperture being defined in said handle wall immediately adjacent said latch lug, said locking means comprising a locking flap overlying said aperture head portion and including a free edge overlying said aperture neck portion, said locking flap being integral with said handle wall beyond said aperture head portion, said locking flap possessing a degree of flexible resiliency for resilient movement away from said aperture head portion upon passage of an aligned lug head portion there through and for subsequent return upon alignment of the lug head portion with the narrower neck portion of the latch aperture whereby realignment of the lug head portion with the aperture head portion is precluded.

13. The carrier of claim 12 wherein said handle wall is defined by a pair of overlying wall panels, one integral with and extending inwardly from each of the opposed handle side panels, said latch lug being defined from one of said wall panels, said locking flap being defined from the other of said wall panels.

14. The carrier of claim 13 wherein said latch means is vertically spaced above said basket, and finger grip means on said handle vertically spaced above said latch means for grasping and raising said carrier.

* * * * *

UNITED STATES PATENT AND TRADEMARK OFFICE

CERTIFICATE OF CORRECTION

PATENT NO. : 5,221,001

DATED : June 22, 1993

INVENTOR(S) : Larry Eisman

It is certified that error appears in the above-indentified patent and that said Letters Patent is hereby corrected as shown below:

Column 5, line 60, "prepresenting" should read --presenting--.

Column 6, line 54, "land" should read --and--.

Column 7, line 39, before "joining" insert --opposed side walls, and a transverse handle wall between and--.

Signed and Sealed this

Twenty-first Day of May, 1996

*Attest:*

BRUCE LEHMAN

*Attesting Officer*

*Commissioner of Patents and Trademarks*